United States Patent [19]

Schuhbauer et al.

[11] 3,941,607

[45] Mar. 2, 1976

[54] METHOD FOR PRODUCTION OF A SURFACE LAYER FOR TRAFFIC AREAS AND THE LIKE

[75] Inventors: Albert Schuhbauer, Hochstadt, Post Wessling; Otto Hieber, Dillingen, both of Germany

[73] Assignee: Alfred Kunz & Co., Munich, Germany

[22] Filed: Oct. 31, 1973

[21] Appl. No.: 411,204

[30] Foreign Application Priority Data

Oct. 31, 1972 Germany ..... 2253495

[52] U.S. Cl. ..... 106/281 R; 106/280; 260/37 EP; 260/37 R

[51] Int. Cl.[2] ..... C08L 95/00

[58] Field of Search ..... 106/280, 28, 281; 404/17, 404/19, 31; 260/37 EP, 37 R

[56] References Cited

UNITED STATES PATENTS

| | | | |
|---|---|---|---|
| 2,759,842 | 8/1956 | Hardman | 106/281 R |
| 3,091,543 | 5/1963 | Rhodes | 106/281 X |
| 3,206,319 | 9/1965 | Minnick et al. | 106/281 X |
| 3,322,706 | 5/1967 | McAninch | 106/273 R X |
| 3,717,492 | 2/1973 | Rinkel et al. | 106/280 R |

FOREIGN PATENTS OR APPLICATIONS

| | | | |
|---|---|---|---|
| 1,251,358 | 10/1967 | Germany | 106/281 R |
| 801,938 | 12/1950 | Germany | 106/281 R |
| 805,887 | 3/1951 | Germany | 106/281 |

*Primary Examiner*—Theodore Morris
*Attorney, Agent, or Firm*—Fleit & Jacobson

[57] ABSTRACT

A surface layer for traffic areas such as roads and airport landing strips is produced by laying a load-carrying structure comprising chip grains of mean diameter of from 2 to 25 mm, with a mean size ratio of not more than 1:3 between the smallest and the biggest grains mainly present in the mixture and a bituminous binder comprising stiffening fillers and/or elastomers, compacting the structure and inducing a flowable mortar of high viscosity to penetrate the structure to its entire depth.

11 Claims, No Drawings

METHOD FOR PRODUCTION OF A SURFACE LAYER FOR TRAFFIC AREAS AND THE LIKE

This invention concerns a method for the production of a surface layer for traffic areas and the like, especially airport landing strips and road surfaces, in which a mixture of broken stone and bituminous binder is spread on the foundation, this structure then being stabilized by mortar entering the voids. These layers may also be used as impervious layers for various purposes, for instance in hydraulic civil engineering.

In German Pat. No. 1 251 358, a method is proposed where on a broken stone layer which contains a bituminous binder, a cement mortar is spread, its consistency being such that the cement mortar will penetrate into the broken stone layer to a limited depth, the entire layer then being compacted. The spreading of the cement mortar is to be done prior to any compaction of the broken stone layer and the flowability of the cement mortar is to be chosen in such a way that it will not penetrate the entire depth of the layer which would lead to a too rigid surface.

Tests have shown that it is very difficult, using the above described method, to construct a regularly porous load carrying structure into which the cement mortar may penetrate to an even depth. Unavoidable variations while adding the separate aggregates in the mixing plants as well as the segregation in the silo, during transport and while placing the mix may lead to a penetration of mortar of varying depths and consequently, varying strength and flexibility.

It is an object of the invention to develop a method of producing a surface layer of more uniform strength and flexibility, the strength and flexibility being greater than that reached by using the above described method.

The invention provides a method for the production of a surface layer wherein a load-carrying structure is laid comprising chip grains of mean diameter in the range from 2 to 25 mm, with a means size ratio of not more than 1:3 between the smallest and the biggest grains mainly present in the commercial grain size (chipping grading of delivery), i.e. not considering the possible small quantities of oversizes and undersizes, and a bituminous binder comprising a stiffening filler and/or elastomer, is compacted, preferably by roller compaction, and a flowable mortar of high viscosity is added to and induced to penetrate the load-carrying structure to substantially its entire depth, preferably by vibration.

The use of the term "chip" throughout this specification does not mean that the individual grains need to be of irregular shape.

By using a load-carrying structure comprising a more or less single chip grain size, i.e. a structure comprising chip grains having a specific grain size without sand, a voids volume of the compacted layer between 18 and 22% by volume can be obtained. This voids volume may be somewhat increased or reduced by modifying the normal 5% by volume of the content of lime stone flour. It is possible to induce the mortar to penetrate the whole of the structure by vibration so that all, or practically all, of the voids of the structure are filled with mortar. This results in a greater stability. On the other hand flexibility is maintained since the chip grains are generally wrapped with a thicker film of the bituminous binder, the total surface area of the chip grains being considerably smaller due to lack of sand and other fine chip components. Thus, the pavement, although able to withstand higher pressures, is more flexible than the one produced according to the known method, since within the thick binder film elastic and plastic deformation is possible.

The adhesion of the desired thicker binder film to the single grain-size chips is improved by addition of stiffening fillers and/or elastomers to the bituminous binder. In preferred embodiments of the invention, asbestos fibres, diatomaceous earth or silicic acid powder may be used as a stiffening filler, and rubber, vinyl-polymers and the like may be used as an elastomer.

For the preparation of the flowable but viscous mortar it is preferred to use a plastics-modified cement mortar with a low watercement ratio (below 0.6), vinyl-polymers being preferred as plastic modifiers. In lieu of cement-mortar also plastics mortar, for instance on the basis of epoxy resin, methylmethacrylate or polyester resin and the like or even mortar with bituminous binders, as for instance soft bitumen, soft tar or PVC-tar, may be used.

Various examples of the composition of the structure follow:

Structure 12 – 18 mm
95 % by vol. broken stone 12–18 mm
5 % by vol. lime stone flour
100 % by vol. minerals
0.6 % by vol. asbestos
3,6 % by vol. bitumen
Structure 8 – 12 mm
95 % by vol. broken stone 8–12 mm
5 % by vol. lime stone flour
100 % by vol. minerals
1.1 % by vol. asbestos
4,4 % by vol. bitumen
Structure 5 – 8 mm
95 % by vol. broken stone 5–8 mm
5 % by vol. lime stone flour
100 % by vol. minerals
1.2 % by vol. asbestos
4,6 % by vol. bitumen
Structure 2 – 5 mm
95 % by vol. broken stone 2–5 mm
5 % by vol. lime stone flour
100 % by vol. minerals
1.0 % by vol. asbestos
4,6 % by vol. bitumen For all the above mentioned mixing ratios a voids volume of 18 to 22% by volume for the structure after roller compaction was reached. Tests have shown it is possible to bring the mortar to complete or almost complete penetration into the structure thus filling all or almost all of the voids in the structure with mortar, leading to improved stability of the finished surface layer.

As stated above, the increase in viscosity of the bituminous binder allowing the use of a relatively large proportion of binder may also be reached by using other stiffening fillers than asbestos fibres and also by adding elastomers.

The following compositions are suitable for the flowable mortar of high viscosity to be used according to the invention:

a. plastics modified cement-mortar
18.5% by weight quartz sand 0.1 – 1 mm
18.5% by weight quartz flour
38.0% by weight cement 6.0% by weight vinyl-ter-polymer
19.0% by weight water
100.0% by weight b. plastics mortar
30.0% by weight epoxy resin + hardening agent (or methylmethacrylate or polyester resin or the like)
10.0% by weight plastorit (active filler)
20.0% by weight quartz flour
40.0% by weight quartz sand 0.1 – 1 mm
100.0% by weight c. Bituminous mortar
20% by weight bituminous binder (soft bitumen, soft tar or PVC-soft tar)
35% by weight lime stone flour
45% by weight quartz sand 0.1 – 1 mm
100% by weight The mixture mentioned under c) has to be poured while hot and will harden upon cooling. This mixture is especially suited for sealing purposes.

The load-carrying structure may be laid in conventional manner and the mortar induced to penetrate it in conventional manner, preferably using vibratory means. The thickness of the layer, the size of the chips and the viscosity of the mortar may be selected according to the use to which the surface layer is to be put and the various other parameters which the engineer conventionally considers.

The embodiments of the invention in which an enclusive property is claimed are defined as follows:

1. A method for the production of a surface layer for traffic areas and the like comprising the steps of:
selecting chip grains from a group of chips having mean diameters in the range of 2 – 25 mm and a mean size ratio of not more than 1:3 between the smallest and the biggest grains;
adding a bituminous binder comprising a stiffening agent to said chip grains;
compacting said chip grain-binder combination;
adding a high viscosity flowable mortar to said compacted combination; and
inducing said mortar to penetrate the combination to substantially the entire depth thereof.

2. A method according to claim 1, in which the bituminous binder comprises asbestos fibre, diatomaceous earth or silicic acid powder as stiffening filler.

3. A method according to claim 1, in which the bituminous binder comprises rubber or a vinyl polymer as an elastomer.

4. A method according to claim 1, in which the mortar is a plastics modified cement-mortar with a water-cement ratio below 0.6:1.

5. A method according to claim 1, in which the plastics constituent comprises a vinyl-polymer.

6. A method according to claim 1, in which the mortar is an epoxy resin, methylmethacrylate or polyester resin based plastics moratar.

7. A method according to claim 1, in which the mortar comprises a bituminous binder selected from soft bitumen, soft tar and PVC-soft tar.

8. The surface layer according to claim 1, including a limestone additive.

9. A method for producing a load carrying flexible surface comprising the steps of:
compacting a mixture of uniformly sized chip grains and bituminous binder having a stiffening filler;
encasing substantially all of the chips in a film of said binder;
forming a voids volume of said compacted mixture of between 18 and 22%;
adding a high viscosity flowable mortar to the compacted mixture;
inducing said mortar to penetrate the compacted mixture to substantially the entire depth thereof; and
filling substantially all of said voids with said flowable mortar.

10. A method for the production of a substantially uniform surface layer for traffic areas and the like comprising mixing chip grains having mean diameters in the range of 2 to 25 mm and a mean size ratio of not more than 1:3 with a bituminous binder having a stiffening agent or elastomer incorporated therein, forming said mixture into a layer, roller compacting said layer to reduce the voids volume of the layer, and causing by vibration a high viscosity flowable mortar to penetrate said compacted layer to substantially the entire depth of said compacted layer to substantially fill said voids volume.

11. A surface layer for traffic areas and the like, comprising a compacted load-carrying structure comprising chip grains of mean diameter in the range of from 2 to 25 mm, with a mean size ratio of not more than 1:3 between the smallest and the biggest grains of the commercial grain size and a bituminous binder comprising a stiffening filler and/or an elastomer and a mortar dispersed throughout the structure.

* * * * *